US005284239A

United States Patent [19]

Kiricoples

[11] Patent Number: 5,284,239

[45] Date of Patent: Feb. 8, 1994

[54] BOTTLE WITH ANTI-ROTATION INSERT

[75] Inventor: Charles P. Kiricoples, Salem, Mass.

[73] Assignee: The Gillette Company, Boston, Mass.

[21] Appl. No.: 71,531

[22] Filed: Jun. 4, 1993

[51] Int. Cl.[5] ..... B65D 43/00

[52] U.S. Cl. ..... 206/229; 215/228; 215/355; 15/257.05; 132/73

[58] Field of Search ..... 215/228, 355; 206/229; 15/257.05; 132/73; 220/307

[56] References Cited

U.S. PATENT DOCUMENTS

| | | | |
|---|---|---|---|
| 968,027 | 8/1910 | Brown | 206/229 |
| 2,627,619 | 2/1953 | Gagen | 15/121.3 |
| 3,146,806 | 9/1964 | Ginsburg | 206/229 |
| 3,280,421 | 10/1966 | Davidson | 15/520 |
| 3,433,712 | 3/1969 | Gerarde | 206/229 |
| 3,930,280 | 7/1976 | Vasas | 15/257.05 |
| 4,241,743 | 12/1980 | Schnabel et al. | 132/88.7 |
| 4,470,425 | 9/1984 | Gueret | 132/88.5 |
| 4,627,454 | 12/1986 | Dahm | 132/88.7 |
| 4,671,689 | 6/1987 | Gueret | 401/122 |

FOREIGN PATENT DOCUMENTS

| | | |
|---|---|---|
| 2005504 | 8/1971 | Fed. Rep. of Germany . |
| 1545627 | 5/1979 | United Kingdom . |
| 2097662 | 11/1982 | United Kingdom . |

*Primary Examiner*—Joseph Man-Fu Moy

*Attorney, Agent, or Firm*—Owen J. Meegan; Aubrey C. Brine; Donal B. Tobin

[57] ABSTRACT

A fluid dispenser for use with an elongated applicator having a container with a reservoir portion and a cylindrical neck portion, a tubular insert fabricated of softer material than the container disposed in the neck portion for receiving the elongated applicator and a rotatable cap which engages the insert when in the sealing position. A plurality of axially disposed vanes are provided on the internal surface of the cylindrical neck portion which serve to cold form the outer surface of the softer insert and become embedded in the insert to prevent rotation of the insert when the cap is removed.

14 Claims, 5 Drawing Sheets

BOTTLE WITH ANTI-ROTATION INSERT

BACKGROUND OF THE INVENTION

The present invention relates to a fluid dispenser assembly of the type employing a container having a tubular insert disposed in the container opening and more particularly to a fluid dispenser assembly of the type for receiving an elongated applicator attached to a screw cap which is employed for sealing the container.

It is known to provide various fluids, such as a correction fluid or the like, in a container such as a bottle wherein the brush-type applicator is attached to a screw cap, and received in the bottle neck when not in use. Such bottles generally are provided with an insert disposed in the bottle neck, the insert having a restricted opening to regulate the amount of fluid dispensed or more particularly through which the elongated applicator is drawn when removed from the bottle to thereby prevent excess fluid from being retained on the applicator.

A problem often arises in that the insert employed is a force fit within the neck of the bottle and is generally inserted into the neck of the bottle having a portion or flange extending over the bottle neck opening which in effect serves as a sealing member when the screw cap is applied to the container. The problem occurs due to the adherence of the screw cap to the flange or upper portion of the insert which may cause the insert to be removed when the screw cap is removed. As fluid accumulates on the insert from dispensing or more particularly from brush wiping and bottle shaking, adhesion between the insert and the cap takes place which allows the insert to be removed with the cap. Without an insert in place, there is no surface to prevent excess fluid from being retained on the applicator, there is little means to regulate the amount of fluid dispensed or no surface for the cap to seal against and there is a larger than desired opening from which fluid may be spilled.

Prior solutions to the above problem have focused on increasing the diametrical interference between the insert and the bottle neck, to include annular rings around the outside of the insert, and/or to include an internal ring on the inside diameter of the bottle lip. While these expedients all increase the retention force of the bottle in the insert, they also increase the insertion force required to assemble the insert into the bottle. Further, the inclusion of rings on the outside of the insert or an internal lip on the bottle neck may create a problem in molding of the insert or the bottle thereby making fabrication of the assembly more complex and therefore more costly.

It is therefore an object of the present invention to provide a fluid dispenser assembly, more particularly a type having a tubular insert which is contacted by a closable screw cap wherein unintended removal of the insert during removal of the screw cap is inhibited.

A further object of the invention is to provide a fluid dispenser of the type described above wherein rotation of the tubular insert due to rotation of the screw cap is inhibited.

Yet another object of the invention is to provide a fluid dispenser of the type described above which is a simple assembly to manufacture and economical to produce.

SUMMARY OF THE INVENTION

The present invention recognizes that when an insert is adhered to the bottle cap, the insert is often caused to unscrew out of the bottle as the cap is unscrewed. Rather than axial pulling of the insert out of the bottle there is a twisting action causing the insert to loosen its grip in the bottle. Therefore, it follows that any inhibiting of the rotation of the insert will result in less incidence of insert removal. In fact, if the bond between the insert and the bottle is greater than the bond between the insert and the cap, the insert will not rotate in the bottle. Increasing the pull out force of the insert will generally provide less improvement than that of inhibiting rotation of the insert in that the pitch angle of the threads generates a substantial mechanical advantage in axial insert movement, in the present embodiment an 18:1 mechanical advantage.

The present invention therefore achieves the objectives set forth above by providing a fluid dispenser assembly, for use with an elongated applicator, which comprises a container having a lower reservoir portion and upper cylindrical neck portion for receiving a tubular insert. The tubular insert has an internal diameter smaller at its lower end than at its upper end for receiving the elongated applicator. The container neck portion is provided with a plurality of axially disposed vanes formed on the internal surface thereof and the outer surface of the tubular insert is of a larger diameter than the internal diameter of the neck portion formed by the vanes. A screw cap is disposed adjacent the upper surface of the container neck portion the screw cap being rotatably attached to the container and to contact the insert when it is in its downwardmost sealing position.

The axially disposed vanes may be equally spaced about the internal surface of the container neck portion and are of generally triangular cross-section.

In the present embodiment, the container is fabricated of rigid plastic material while the tubular insert is fabricated of a low density polyethylene or similar material to provide cold forming of the tubular insert when it is pressed into the axially disposed vanes in the neck of the container.

The tubular insert generally comprises an outwardly extending flange, formed at the upper end thereof the flange extending outwardly over the neck portion of the container between the neck portion and the screw cap to form a seal between the neck portion and the screw cap when the screw cap is in the sealing position.

BRIEF DESCRIPTION OF THE DRAWING

Reference is made to the accompanying drawing in which there is shown an illustrative embodiment of the invention from which its novel features and advantages will be apparent, wherein.

DESCRIPTION OF THE PREFERRED EMBODIMENT

Figure 1:
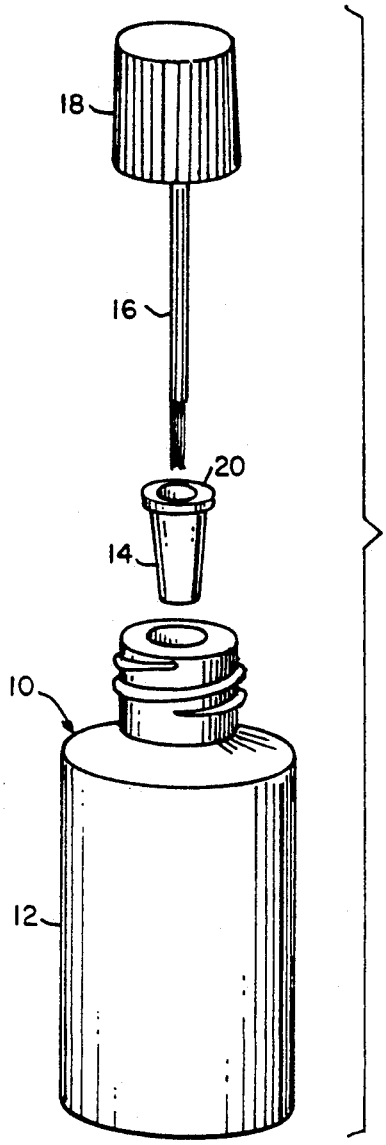
FIG. 1 is an exploded view, partially in section showing a fluid dispenser constructed in accordance with the teachings of the present invention.

Referring now to FIGS. 1 through 5 of the drawing there is shown a fluid dispenser assembly 10 comprising a bottle 12 employed as a container for the fluid, a tubular insert 14 and an elongated applicator 16 attached to the inner surface of a screw cap means 18, the outwardly extending flange of the applicator 16 forming the inner surface 30 of the cap means.

Figure 5:
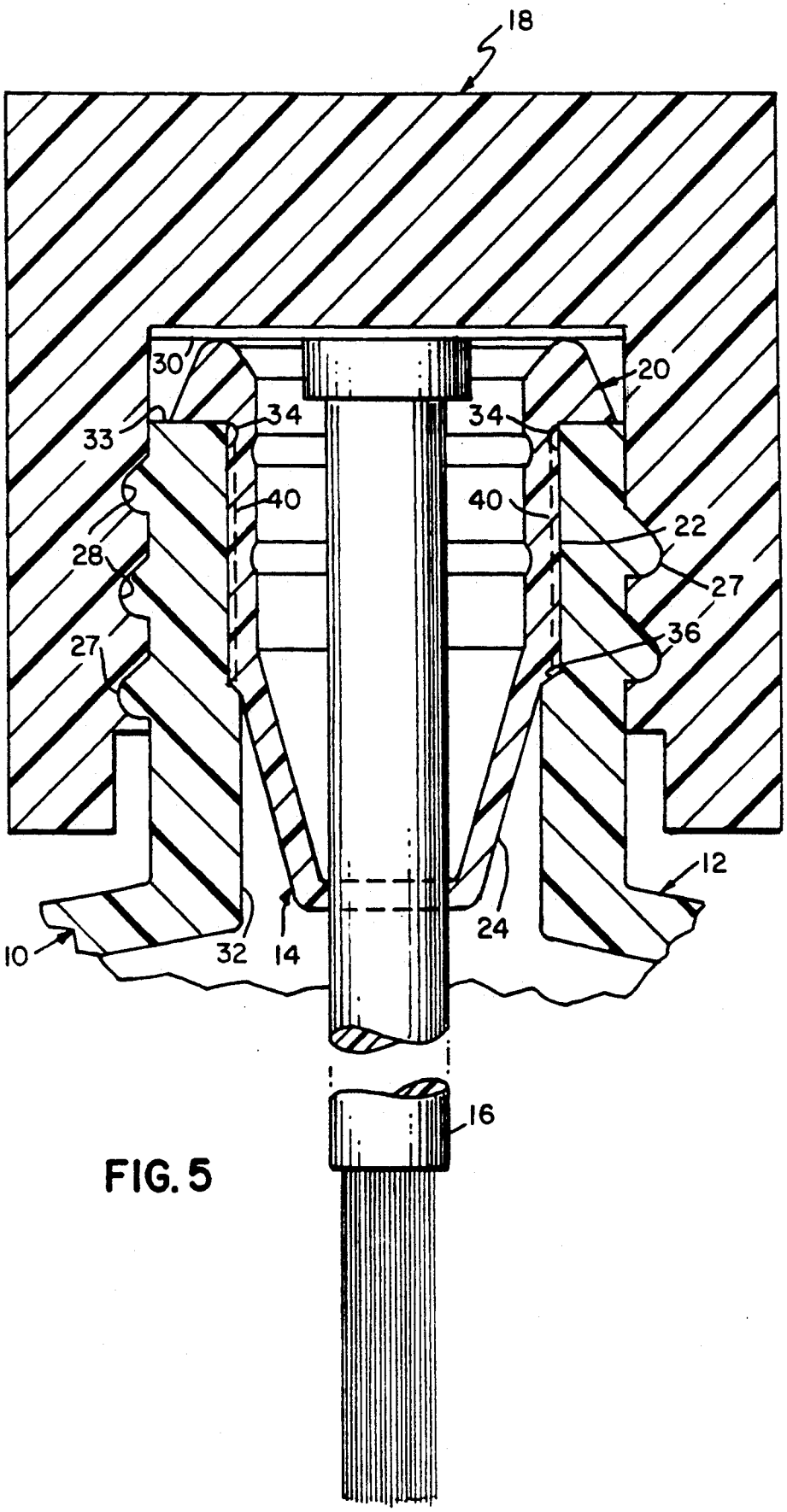
FIG. 5 is a sectional elevational view showing a portion of the fluid dispenser of FIG. in the assembled condition.

The insert 14 is formed of an outwardly extending flange 20 forming the upper opening in the tubular insert as best shown in FIG. 5. The insert 14 further comprises a cylindrical portion 22 and a frustum-shaped portion 24, the cylindrical portion 22 tapering from under the flange 20 to its intersection with the frustum-shaped portion 24 by a degree which is not readily apparent by observation, but is detectable through micrometer measurement. Both the cylindrical portion 22 and frustum-shaped portion 24 have a smooth unobstructed surface as does the surface under the flange 20 of the tubular insert 14.

Referring now particularly to FIGS. 2, 3, 4 and 5, the bottle 12 has a neck 26 having external threads 27 which are formed for mating engagement with the internal threads 28 (only shown in FIG. 5) in the screw cap means 18. The threads 27 and 28 are of a length to ensure that the inner surface 30 of the cap 18 is allowed to sealingly engage the flange 20 of the tubular insert 14 by rotating the screw cap means 18 firmly onto the neck 26 of the bottle 12.

Figure 2:
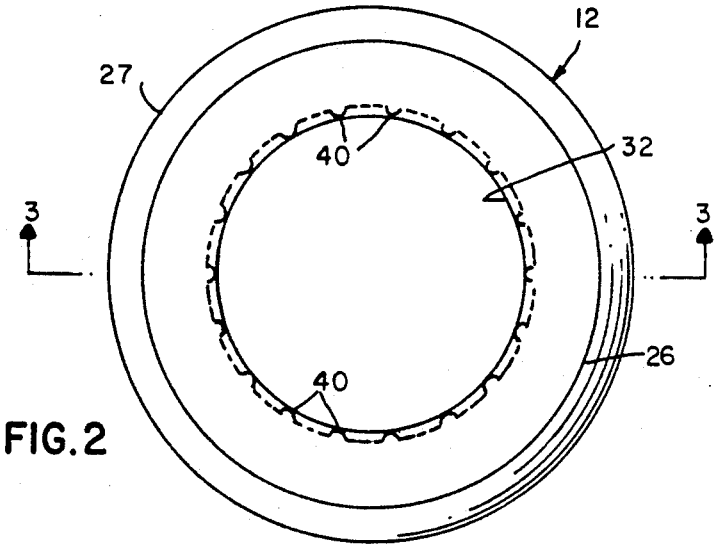
FIG. 2 is a top plan view of the neck portion of the container of FIG. 1, showing details of the structure on an enlarged scale for clarity.
Figure 3:
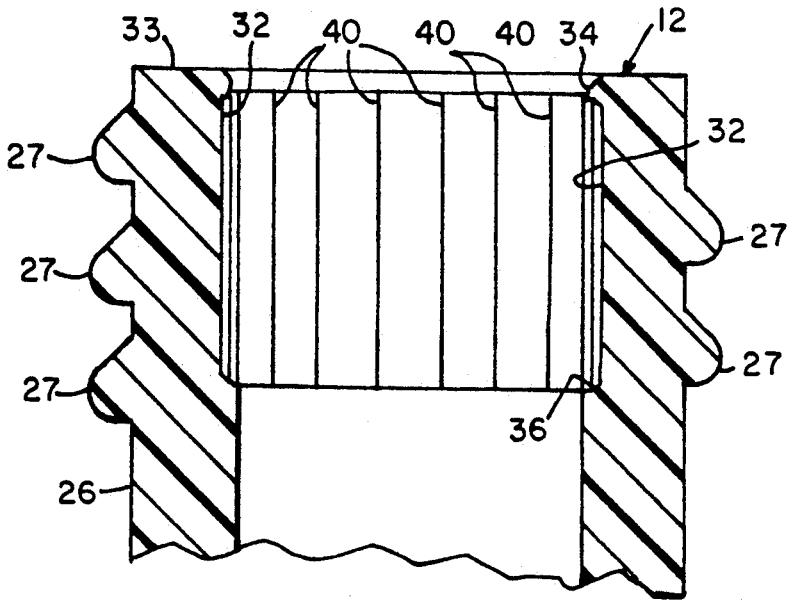
FIG. 3 is a fragmentary sectional view taken along the line III—III of FIG. 2, showing further details of the container neck portion.
Figure 4:
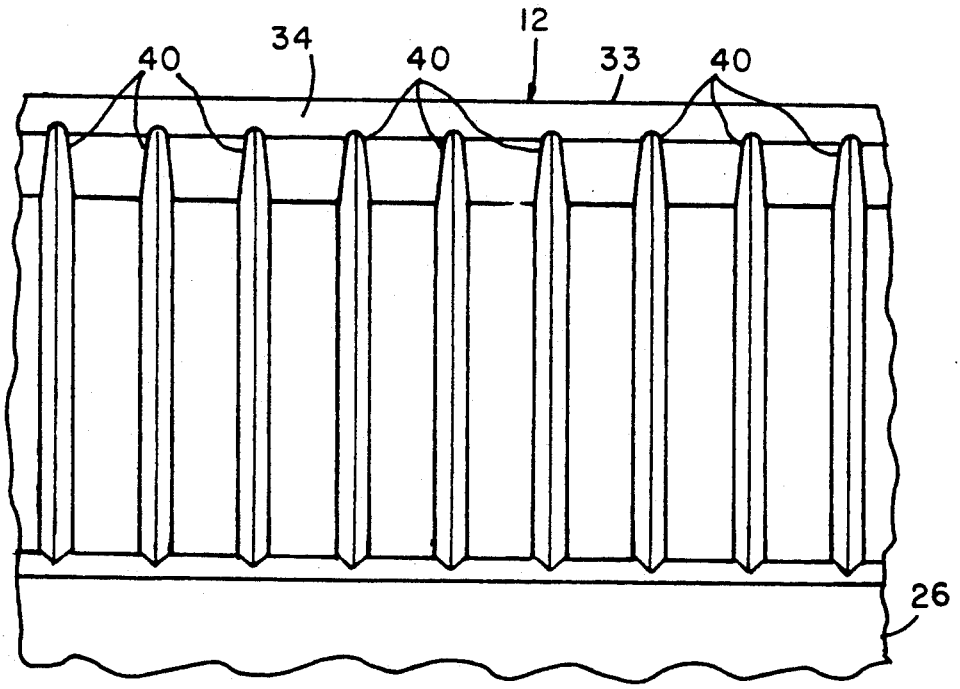
FIG. 4 is a view similar to FIG. 3 wherein the inner surface of the container neck portion is unrolled into a plane surface to show the inner surface as a flat pattern of vanes.

As best shown in FIGS. 2, 3 and 4, the bottle neck 26 has an opening 32 terminating in a planar surface 33, the planar surface being disposed for seating of the underside of the flange 20 when the tubular insert 14 is in place. At the inner circumference of the surface 33 a bottle neck lip 34 extends into the opening 32. A shoulder 36 is disposed on the inner surface of the neck 26 substantially at a 45° angle forming a recessed portion 38 between the neck lip 34 and the shoulder 36 on the internal surface of the neck. A plurality of axially disposed vanes 40, substantially triangular in cross-section, are formed in the recess portion 38 between the neck lip 34 and the shoulder 36, the vanes 40 extending substantially the same distance into the bottle neck as the length of the cylindrical portion 22 of the tubular insert 14. As shown in FIG. 4 depicting the internal surface of the bottle neck 26 as a flat plane, the vanes 40 are equally spaced about the internal surface of the neck 26 and in the present embodiment are eighteen (18) in number.

Referring back to FIG. 5, in the present embodiment the bottle 12 is manufactured of a rigid plastic material such as Barex, which is a trade name of British Petroleum, while the tubular insert 14 is manufactured of a low density polyethylene. It is however only necessary that the material of the bottle 12 be of different rigidity from the tubular insert 14 so that the vanes 40 on the bottle 26 be of sufficient rigidity to deform the outer surface of the tubular insert and imbed themselves in the tubular insert when the two are mated as shown in FIG. 5. As is evident from FIG. 5, the vanes 40 formed on the internal surface of the bottle neck 26 form an internal circumference having a lesser diameter than the diameter of the outer surface of the tubular insert thereby causing an interference fit between the outer surface of the tubular insert 14 and the vanes 40. In assembling the fluid dispenser assembly 1, the tubular insert is forced longitudinally into the neck of the bottle 12, the vanes 40 serving to deform the outer surface of the tubular insert 14, the tubular insert being forced in until the lower surface of the flange 20 contacts surface 33 of the bottle neck 26. When the screw cap means 18 is applied to the assembly 10 it is rotated until the cap inner surface 30 contacts the flange 20 and a tight seal is created between the screw cap means 18 and the tubular insert 14.

Thereafter, when the screw cap means 18 is rotated either in the sealing direction or unsealing direction, should a bond be formed between the screw cap and the tubular insert 14 the tubular insert is inhibited from rotation within the bottle neck 26 by the formation of the vanes 40 within the softer material of the insert 14 and the bond is broken between the insert and the screw cap means preventing subsequent removal of the insert from the bottle, as often occurs in the prior art.

In the present embodiment the opening 32 in the neck of the bottle 12 is provided with eighteen (18) vanes 40 which at their innermost tips form a circumference having a radius value of 7.366 mm. while the cylindrical portion 22 of the tubular insert 14 tapers from a maximum value 8.20 mm. at a point directly under the flange 20 to a value of 7.95 mm. at the point of intersection between the cylindrical portion 22 and the frustum-shaped portion 24.

Figure 6:
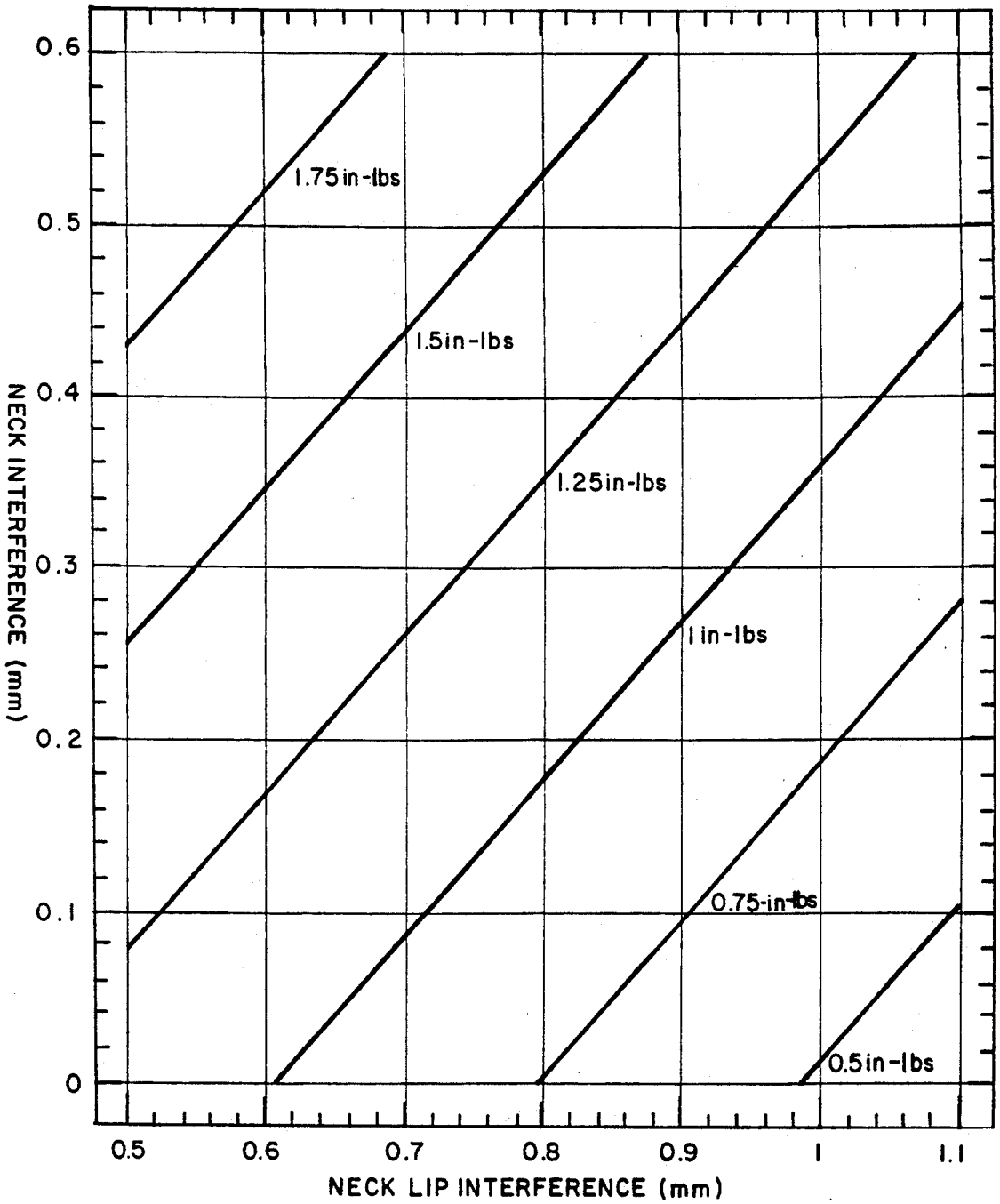
FIGS. 6 and 7 are charts showing a comparison of the prior art and the present invention, as depicted in FIGS. I through 5.
Figure 7:
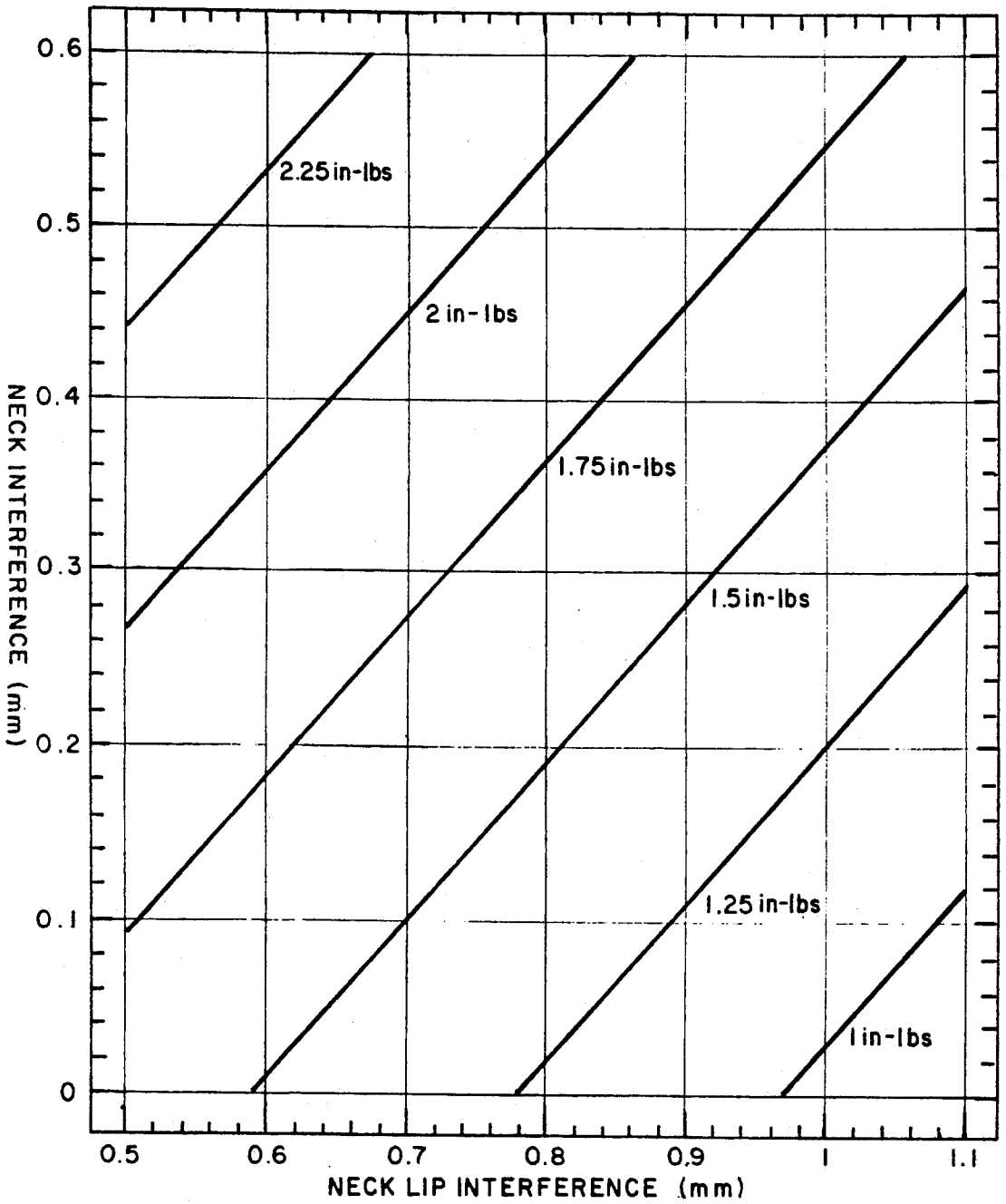

Referring now to FIGS. 6 and 7, a mathematical model of a bottle neck 26 having vanes 40 was constructed from a regression analysis of empirical data. The data was derived from experiments with bottles having two different internal neck configurations and from inserts having various outside diameters. The mathematical model describes a relationship between the dependent variable "torque to twist the insert" and the three independent variables "neck ribs - yes/no", interference between inside neck diameter and insert diameter and interference between inside neck lip diameter and insert outside diameter. The two neck configurations were:

1) A smooth internal neck with a slightly reduced diameter at the internal neck lip; and 2) A similarly configured internal neck and internal lip but with eighteen (18) axially aligned uniformly spaced vanes.

The interference between the inside diameter of the bottle neck lip and the outside diameter of the insert was varied by selecting inserts with various outside diameters. The interference between the inside diameter of the bottle neck and the outside diameter of the insert was varied in a similar manner. Both interference levels between insert and either neck or neck lip internal diameter were measured on each assembly prior to testing. This provided a paired testing environment rather than a group testing environment and allowed for a natural variation between the two interferences.

As the charts show, decreasing the neck lip interference or increasing the neck interference, the torque to twist the insert is increased. This result is true for either the ribbed or the smooth neck, but the two charts show that the twist torque is higher for the ribbed neck than for the smooth neck, for any given value of neck lip or neck interference, by 0.478 inch pounds.

The negative influence of the neck lip interference is interpreted as follows: the result of increasing the neck lip interference is similar to that of having a cone-shaped element which is oiled, or in some other manner slippery. As the cone is squeezed it is forced to move longitudinally and in the present instance the slight taper on the outside diameter of the insert 14, which is provided for processing reasons, causes the bottle neck lip to help force the insert out of the neck area as the interference is increased therefore reducing the torque required to twist the insert within the bottle neck.

It should be understood that the providing of vanes 40 which are longitudinally formed within the bottle neck is well adapted to the molding process in that the vanes are longitudinal to the axis of the bottle and therefore simple to form in a blow molding process, which is generally employed to form bottles of this type.

While it is apparent that changes and modifications can be made within the spirit and scope of the present invention, it is my intention, however, only to be limited by the appended claims.

As my invention I claim:

1. A fluid dispenser assembly for use with an elongated applicator; comprising a container having a lower reservoir portion and an upper cylindrical neck portion;

a tubular insert disposed in said cylindrical neck portion having an internal diameter smaller at its lower end than at its upper end for receiving said elongated applicator therein;

said container neck portion having a plurality of axially disposed vanes formed on the internal surface thereof and the outer surface of said tubular insert being of a larger diameter than the internal diameter of said neck portion formed by said vanes; and a screw cap means disposed adjacent the upper surface of said container neck portion, said screw cap means being rotatably attached to said container and contacting said insert when in its downwardmost sealing position.

2. A fluid dispenser as set forth in claim 1 wherein said axially disposed vanes are substantially triangular in cross-section.

3. A fluid dispenser as set forth in claim 1 wherein said plurality of axially disposed vanes are equally spaced about the internal surface of said container neck portion.

4. A fluid dispenser as set forth in claim 1 wherein said plurality of axially disposed vanes are at least 18 in number.

5. A fluid dispenser as set forth in claim 1 wherein said container is fabricated of a rigid plastic material and said tubular insert is fabricated of a low density polyethylene material.

6. A fluid dispenser as set forth in claim 1 wherein said tubular insert comprises an outwardly extending flange formed at the upper end thereof, said flange extending outwardly over the neck portion of said container between said neck portion and said screw cap means and forming a seal between said neck portion and said screw cap means with said screw cap means in the sealing position.

7. A fluid dispenser as set forth in claim 2 wherein said plurality of axially disposed vanes are equally spaced about the internal surface of said container neck portion.

8. A fluid dispenser as set forth in claim 7 wherein said plurality of axially disposed vanes are at least 18 in number.

9. A fluid dispenser as set forth in claim 8 wherein said container is fabricated of a rigid plastic material and said tubular insert is fabricated of a low density polyethylene material.

10. A fluid dispenser as set forth in claim 9 wherein said tubular insert comprises an outwardly extending flange formed at the upper end thereof, said flange extending outwardly over the neck portion of said container between said neck portion and said screw cap means and forming a seal between said neck portion and said screw cap means with said screw cap means in the sealing position.

11. A fluid dispenser assembly comprising a container having a lower reservoir portion and an upper cylindrical neck portion;

a tubular insert disposed in said cylindrical neck portion;

said container cylindrical neck portion and said tubular insert being formed of plastic materials having different rigidity;

a plurality of axially disposed vanes formed in the plastic having the greater rigidity; and a screw cap means disposed adjacent the upper surface of said container neck portion, said screw cap being attached to and removed from said container by rotation thereof relative to said container neck portion and contacting said insert when in its downwardmost sealing position.

12. A fluid dispenser as set forth in claim 11 which further includes an elongated applicator disposed on the inner surface of said screw cap means and extending downwardly through said tubular insert into said container reservoir portion.

13. A fluid dispenser as set forth in claim 11 wherein said axially disposed vanes are substantially triangular in cross-section.

14. A fluid dispenser as set forth in claim 1 wherein said tubular insert comprises an outwardly extending flange formed at the upper end thereof, said flange extending outwardly over the neck portion of said container between said neck portion and said screw cap means and forming a seal between said neck portion and said screw cap means with said screw cap means in the sealing position.

* * * * *